United States Patent [19]

Tucker

[11] 4,385,905

[45] May 31, 1983

[54] SYSTEM AND METHOD FOR GASIFICATION OF SOLID CARBONACEOUS FUELS

[75] Inventor: Gordon H. Tucker, Enumclaw, Wash.

[73] Assignee: Everett Metal Products, Inc., Everett, Wash.

[21] Appl. No.: 284,605

[22] Filed: Jul. 20, 1981

Related U.S. Application Data

[63] Continuation of Ser. No. 142,061, Apr. 4, 1980, abandoned.

[51] Int. Cl.[3] ..... C10J 3/66

[52] U.S. Cl. ..... 48/62 R; 48/77; 48/63; 48/111; 48/197 R; 48/202; 48/209; 422/211

[58] Field of Search ..... 48/202, 206, 63, 64, 48/77, 111, 209, 197 R, 62 R; 201/16, 37, 2.5; 110/229; 202/113, 109, 99, 117, 121; 422/211, 187

[56] References Cited

U.S. PATENT DOCUMENTS 927,418 7/1909 Loomis et al. ..... 48/202
3,844,733 10/1974 Donath ..... 48/202
4,268,275 5/1981 Chittick ..... 48/111
4,278,446 7/1981 Von Rosenberg, Jr. et al. .... 48/206

*Primary Examiner*—William F. Smith
*Attorney, Agent, or Firm*—Seed, Berry, Vernon & Baynham

[57] ABSTRACT

A system is disclosed for the conversion of solid carbonaceous fuels to combustible gases having a high energy content. The system utilizes a two-stage reaction system where a particulate fuel is entrained in a high velocity, hot gas stream emanating from a fixed-bed char reactor, the particulate fuel delivered to a gasification reactor by the hot gas stream while being rapidly heated (fast pyrolized). The gases produced are drawn a fixed distance through a bed of char at the bottom of the gasification reactor, after which they are withdrawn from the reactor and cooled. To promote methanation, the generated gases, after passing through the fixed bed of char in the gasification reactor, exit the reactor through a dip leg within the reactor filled with a catalyst which promotes methanation. Char from the gasification reactor is continuously removed and delivered to the fixed-bed char reactor where an oxygen-containing gas (air or oxygen) and steam are injected into the bed of char to produce the hot gas stream used to entrain the incoming particulate solid fuel.

10 Claims, 1 Drawing Figure

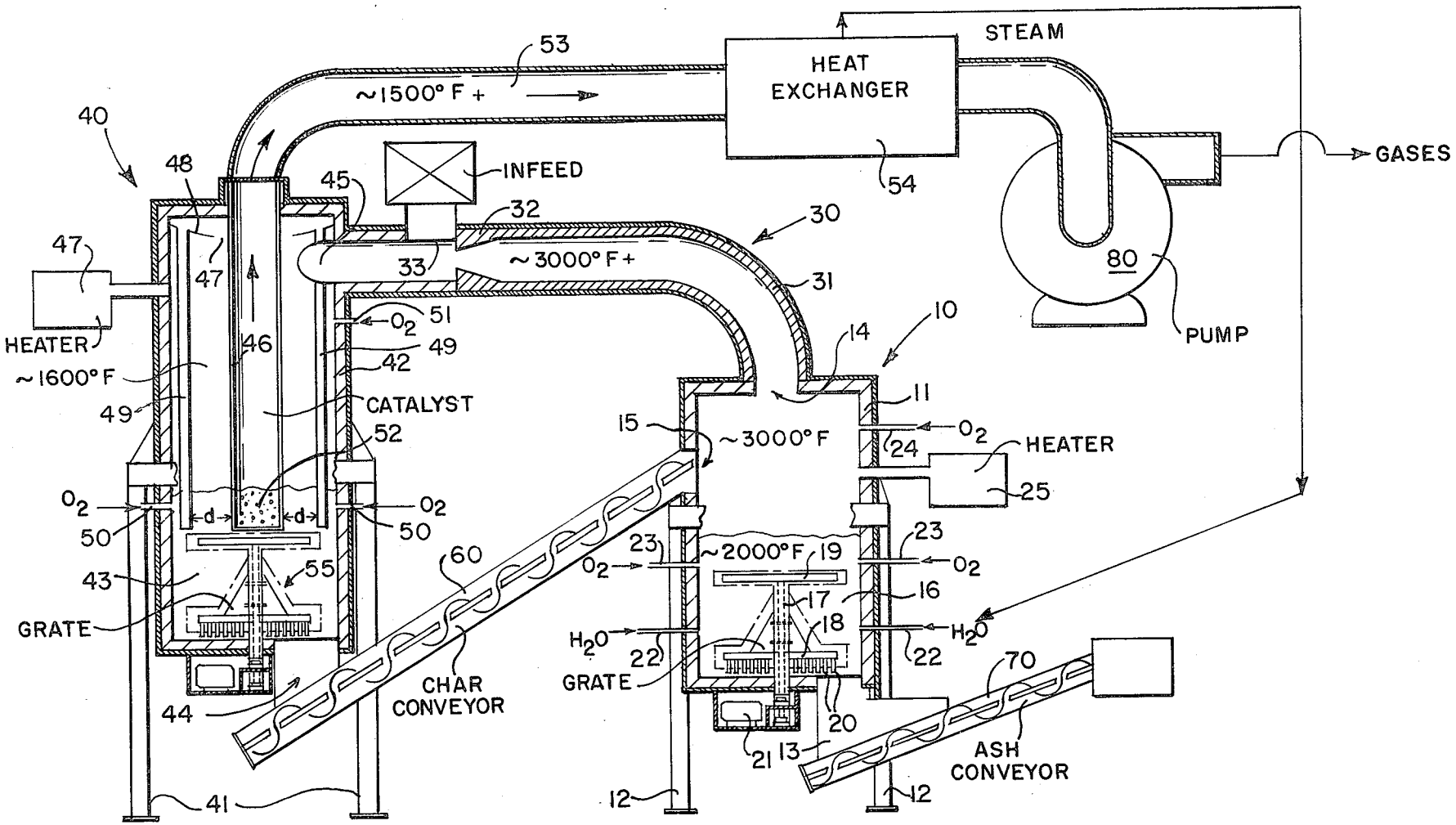
GASES
PUMP
80
STEAM
HEAT EXCHANGER
54
HEATER
25
$O_2$
$H_2O$
ASH CONVEYOR
70
10
11
24
23
16
22
12
14
30
31
~3000° F
19
17
18
20
13
21
~2000° F
15
GRATE
53
~1500° F +
INFEED
32
~3000° F +
33
51
49
42
CATALYST
52
50
60
CHAR CONVEYOR
45
55
46
47
48
44
41
40
HEATER
~1600° F
43

SYSTEM AND METHOD FOR GASIFICATION OF SOLID CARBONACEOUS FUELS

This application is a continuation of United States patent application Ser. No. 142,061, filed Apr. 4, 1980 now abandoned.

BACKGROUND OF THE INVENTION

1. Field of the Invention

This invention relates to a gasification system for carbonaceous solid fuels and to a method of gasifying such.

2. Prior Art Relating to the Disclosure

Gasification of solid fuels, such as biomass and coal, has become of increasing interest and importance because of rapidly rising petroleum prices, dwindling domestic petroleum and natural gas resources, and the increased dependence by the United States on foreign petroleum imports. Gasification of coal and biomass has been widely practiced for over 100 years, and there are many varieties and types of gasifiers and routes to gasification. Generally, however, they all fall into the following categories:

1. Pyrolysis
2. Air gasification
3. Oxygen gasification
4. Anaerobic digestion

Pyrolysis is the breakdown of biomass by heat at temperatures of 200°–600° C. to yield a medium energy gas, a complex pyrolysis oil and char. All biomass gasification and combustion processes involve pyrolysis as a necessary first step. There are two kinds of pyrolysis—slow and fast. At slow heating rates or with large pieces of biomass, pyrolysis leads to a high proportion of charcoal which must then be gasified. At rapid heating rates, cellulose, for example, is converted to a gas containing a high proportion of olefins that are valuable as a chemical feed stock. Char production is minimal. Fast pyrolysis of finely divided biomass results in maximum gas yields.

Air gasification of solid carbonaceous fuels, while requiring an initial pyrolytic step, uses a minimal quantity of air and steam to convert the char remaining from pyrolysis to gas in a single unit. The gas produced is a low energy gas (LEG) because it is diluted by the nitrogen of the air.

Oxygen gasification of solid carbonaceous fuels produces a medium energy gas composed primarily of carbon monoxide and hydrogen. It can be used for chemical synthesis or to make methanol, ammonia, hydrogen, methane or gasoline, and is called "syngas."

Hydro-gasification of solid carbonaceous fuels is where hydrogen gas is added under high pressure for direct and high yields of methane.

Anaerobic digestion produces methane and carbon dioxide biologically from manure or sewage. It is not generally though of as a gasification process.

The difficult problem in gasification is the conversion of all of the elements comprising the solid biomass into gases containing the highest amount of energy. Gasification at lower temperatures produces a high proportion of oil in addition to char. Conversion of this char and oils to gases can be done by the four basic types of gasification referred to earlier, i.e., air gasification, oxygen gasification, hydro gasification and pyrolytic processes. Gasifiers of numerous configurations are known and generally fall into four categories, namely:

1. Entrained flow
2. Fluidized bed
3. Fixed bed
4. Molten media Gasifiers which are either commercially available or are considered to have potential of becoming commercially available are described extensively in *Handbook of Gasifiers and Gas Treating Systems,* Final Report, Task Assignment No. 4, Engineering Support Services, by Dravo Corporation, Pittsburgh, Pa., prepared for the United States Energy Research and Development Administration under Contract No. 4(49–18)1772 (February 1976).

Gasifiers may also be classified as either updraft gasifiers or downdraft gasifiers. In downdraft gasifiers, combustion occurs first and the gases are then drawn through the hot char. In fluidized bed reactors a number of variations of temperature can be used to produce specific intermediate equilibrium states giving better control over gas composition. In updraft gasifiers, air or oxygen is drawn up through a fixed bed of biomass resting on a grate. At the lowest and hottest level on the grate, combustion and char gasification occur. As the gases rise, they reach successively lower temperature pyrolysis and drying zones and exit the gasifier at a low temperature saturated with pyrolysis oils and water. Such oil production is largely eliminated in downdraft gasifiers where air is introduced between the char zone and the pyrolysis zone with heat from the char zone pyrolyzing the biomass above. In this case, the tars and oils pass through a bed of hot charcoal where they are cracked and reduced mostly to hydrogen and carbon monoxide.

Oxygen and air gasifiers consume char directly by increasing the oxygen content of the biomass to permit gas formation. In pyrolysis, gas, oil and char are all formed simultaneously, with the char and oil subsequently converted in a separate reactor to heat additional gas with recirculation of the hot gases as a heat exchange medium for additional conversion of the char and oil to gas.

The four types of gasifiers mentioned and the type of gas produced depend on the number of parameters, including fuel type (biomass, solid municipal waste, peat, coal, etc.); fuel size (chunks, shreds, pellets, powders); fuel gas contact (updraft, i.e., counterflow; downdraft, i.e., coflow, fluidized bed or suspended particles); ash form (dry ash for temperatures below 1100° C. or slagging for temperatures above 1300° C. depending on feed); pressure; and catalyst use.

An extensive survey of biomass gasification is given in "A Survey of Biomass Gasification"—Volume 1, "Synopsis and Executive Summary," SERI/TR-33239, July 1979, Solar Energy Research Institute. Additionally, process and equipment information on conversion of biomass to fuels and chemicals is given in a report by SRI International for the U.S. Department of Energy entitled "Mission Analysis for the Federal Fuels from Biomass Program," Vol. 4, Thermochemical Conversion of Biomass to Fuels and Chemicals (January 1979).

SUMMARY OF THE INVENTION

One of the primary objects of this invention is to provide a gasification system and method for the gasification of solid carbonaceous fuels to produce combustible gases having a high energy content.

Another object of this invention is to provide a gasification system for gasification of solid carbonaceous fuels employing a fixed-bed char reactor in combination with a gasification reactor also having a fixed bed of char therein, means for entraining the particulate fuel to be gasified in the gasification reactor in a hot gas stream generated by the char reactor and means for withdrawing the gases generated in the gasification reactor through the bed of char therein.

A further object of this invention is to provide a method and system for gasification of solid carbonaceous fuels wherein particulate solid fuels are metered into a high velocity, hot gas stream coming from a fixed-bed char reactor, the gas stream having a velocity sufficient to entrain the particulate solid fuel in the hot gas stream. The hot gas stream, containing little or no oxygen, rapidly pyrolyzes the particulate materials while delivering them to a gasification reactor containing a fixed bed of char maintained at a temperature of from 1200°–1800° F. The gases generated in the gasification reactor are drawn a fixed distance through the bed of char at the bottom of the reactor and may then be contacted with a catalyst which promotes methanation, such as iron particles, iron wool or other such catalyst. The exiting gases may then be run through a heat exchanger to cool them and extract the heat content thereof for other uses. The char in the gasification reactor is continuously removed and fed to the fixed-bed char reactor where steam and oxygen or an oxygen-containing gas are injected thereinto to gasify the char and generate a hot gas stream having a temperature of from 2000°–4000° F. which is used to entrain the solid particulate fuel fed to the gasification reactor.

It is a further object of this invention to provide a gasification system and method wherein the thermal efficiency of the unit is about 85 percent and the gas generated from the unit has a heat content of from 800–1000 BTU/ft$^3$.

DETAILED DESCRIPTION OF THE PREFERRED EMBODIMENTS

The schematic diagram illustrates a two-stage reactor system utilizing two separate reactors. It should be understood, however, that an integral reactor having two separate reaction zones may be used in place of the two separate reactor vessels. As illustrated, the system includes a char bed reactor 10 and a gasification reactor 40, the two reactors connected by a refractory-lined conduit 30.

The char bed reactor 10 is lined with an insulative refractory lining 11. The reactor vessel is supported on legs 12 and has an opening in the bottom wall 13 through which char exits from the reactor. The vessel also includes an opening in the top wall 14 through which gases generated in the unit exit the vessel and an opening in the side wall 15 through which char from the gasification reactor is fed by a char conveyor 60. The reactor has a char bed 16 therein which is continuously stirred during operation by a rotary grate. The grate includes a central shaft 17 to which a set of lower arms 18 and upper arms 19 are attached. The arms extend at right angles to one another from their connection to the shaft. Each of the lower arms also includes a plurality of downwardly depending fingers 20 which serve to stir and keep the char bed from compacting. The grate is protected by a layer of insulative refractory lining. The shaft is driven by a motor 21 connected thereto by suitable reduction gearing. The char reactor also includes means for injecting water or steam and air or oxygen into the interior of the reactor. One or more steam inlets 22 are provided for injecting steam into the reactor at a level beneath the surface of the char bed. One or more inlets 23 are also provided for injecting oxygen or air into the bed or beneath the bed of the reactor as illustrated. It is also desirable to include one or more inlets 24 for injecting air or oxygen into the reactor above the level of the char bed for purposes to be described. The reactor may also include an auxiliary heater 25 for initially heating the bed of char in the reactor to operating temperature.

Gases generated in the char bed reactor exit the reactor through conduit 30 which is lined with refractory 31. A venturi 32 is positioned in the conduit. The venturi is designed to increase the velocity of the hot gases exiting from the char bed reactor through the conduit sufficiently to entrain the particulate fuel injected into the hot gas stream through an infeed inlet 33 located downstream from the venturi 32. The venturi is preferably a "dumping type" venturi wherein the velocity of the gases is increased by decrease of the area of the conduit on the infeed side of the venturi while allowing the pressure to abruptly drop due to an abrupt increase in the area of the venturi on the downstream side of the venturi to aid in entraining the particulate fuel in the gas stream, due to turbulent mixing. The particulate solid fuel is fed into the conduit by any suitable feed means. Preferred is a conventional and commercially available rotary air lock feeder having multiple pockets containing the particulate fuel to be fed into the gasification reactor.

The gasification reactor 40 is also supported on legs 41. The interior walls thereof are lined with an insulative refractory lining 42. A char bed 43 occupies the lower portion of the reactor, the char bed agitated and kept in motion by a rotary grate 55 of similar construction and operation as that of the char bed reactor. The reactor includes an opening in the bottom wall 44 for dumping of char from the bed 44 into a char conveyor 60 which conveys it to the char bed reactor. An opening 45 in the side wall of the reactor receives the hot gases from the char bed reactor containing the entrained particulate solid fuel. A further opening in the top wall of the gasification reactor receives a dip leg 46 extending beneath the surface of the char bed. The gasification reactor also contains means for withdrawing gases generated in the upper zone of the gasification vessel and feeding them through the char bed in the lower zone thereof before exit of the gases from the reactor through the dip leg. The lower end of the dip leg extending beneath the surface of the char bed is perforated to receive the gases exiting from the downcomer tubes 49 through the char bed. The gases generated in the gasification reactor exit through an opening 47 in a baffle 48 surrounding the dip leg and flow through a series of downcomer tubes 49 spaced circumferentially around the dip leg. The lower ends of each of the tubes 49 extend beneath the surface of the char bed. The gasification reactor also includes openings 50 beneath the surface of the char bed in the reactor for injection of air and/or oxygen thereinto. Means 51 may also be provided for injecting air and/or oxygen into the upper reaction zone above the char bed as illustrated.

It is important that the gases generated in the gasification reactor be withdrawn an equal distance through the char bed before exit from the reactor. As illustrated, the gases generated in the gasification zone, as well as those generated by the char bed reactor, exit through the openings 47 and are pulled beneath the char bed through a plurality of downcomer tubes extending around the circumference of the reactor and through the char bed. The gases flow a fixed distance "d" through the char bed before exiting through perforations 52 in the dip leg.

The hot gases exiting the gasification reactor through conduit 53 may be run through a heat exchanger 54 for generation of steam for use for carrying out the reaction or for other purposes. The cooled gases exiting from the heat exchanger may be used directly for generation of heat, as a chemical feed stock or for other purposes.

The respective speeds of char conveyor 60 and ash conveyor 70 are coordinated to maintain the levels of the respective beds in the reactors substantially constant.

Method of Operation

Referring to the schematic, the char bed reactor 10 is loaded with charcoal briquettes or other solid carbonaceous fuel to a level above the air or oxygen inlets 23. After loading, the heater 25, which may be a propane, oil or gas heater, is activated to heat the reactor and the contents to a temperature of between 1200°-1300° F. This results in charring if a carbonaceous fuel, such as wood wastes, is employed. When the bed has been sufficiently heated, a small amount of air or oxygen and steam is injected into the char bed through inlets 22 and 23 beneath the top surface thereof. The oxygen and steam react with the carbon in the char bed to generate gases containing principally carbon monoxide. The reaction is exothermic and therefore increases the temperature of the bed within the reactor to approximately 2000° F. or more. Air and/or oxygen may be injected through inlets 24 to further increase the temperature of the gas stream by the exothermic conversion of carbon monoxide to carbon dioxide. The gases generated in the char bed exit the reactor through conduit 30, preferably at a temperature of about 3000° F. and a pressure of about 1-2 psig. The gases flow through a dumping venturi 32 whose area is about one-half to one-fourth the area of the incoming conduit. This results in an increase in velocity of the gases such that particulate solid fuels fed into the hot gas stream on the downstream side of the venturi are entrained in the very hot gas stream. The exposure of the solid particulate fuels to the hot gas stream results in fast pyrolysis of the solid particulate fuels simultaneously with entry of the entrained solid fuels into the upper zone of the gasification reactor.

At the same time the char bed reactor is loaded with charcoal briquettes or other solid carbonaceous fuel, the gasification reactor is also loaded with charcoal briquettes and heated with an auxiliary heater 47 to 1200°-1300° F. Oxygen or air is injected into the char bed to increase the temperature of the char bed to 1200°-1300° F.

Once the exiting gases from the char bed reactor are sufficiently hot to instantly pyrolyze the incoming particulate solid fuel, the auxiliary heater 25 is turned off and the system is balanced by injection of air or oxygen and steam into the char bed of the char bed reactor and air or oxygen into the char bed of the gasification reactor to maintain the temperature substantially constant. At the same time, the speeds of the char bed conveyor, the ash conveyor and the amount of fuel fed into the gasification reactor are coordinated to maintain the level of the beds in each reactor substantially constant.

The size of the particulate solid fuel fed into the system generally ranges from one-fourth inch to one-sixteenth inch in thickness or diameter. Larger or smaller particle sizes may be used, depending on the velocity of the gases into which the particulate fuel is fed.

If it is desired to generate a combustible gas mixture coming from the gasification reactor containing a major amount of methane, the dip leg tube 46 may be filled with a catalyst, such as iron wool or chrome/nickel stainless mesh or other suitable catalyst which promotes methanation of the gas stream.

The gasification reactor is, in effect, both an entrained reactor and a fixed-bed reactor. When the particulate fuel injected into the hot gas stream coming from the char bed reactor is pyrolyzed in the upper zone of the gasification reactor, the condensible pyrolysis oils generated are cycled through the bed of char in the lower zone of the gasification reactor where they are broken down at high temperature so that the gases leaving the gasification reactor contain a minimum amount of condensibles and a maximum amount of other useful gases, such as hydrogen, etc. The temperature of the char bed in the gasification reactor is preferably maintained between about 1600°-2200° F. Temperatures less than 1600° F. result in slow reaction. The temperature of the bed in the char bed reactor is preferably maintained at a temperature of about 1800°-2500° F. This is done by injection of steam which reacts with the carbon in the bed at the high temperature conditions to generate, principally, carbon monoxide. Air or oxygen injected into the reactor above the char bed results in increased temperature of the gas stream to 3000° or more by the exothermic conversion of the carbon monoxide to carbon dioxide. The generation of the hot gas stream in the char bed reactor by injection of air and/or oxygen and steam into the char bed is an exothermic reaction, whereas the pyrolysis reaction occurring in the upper zone of the gasification reactor is principally an endothermic reaction. The amount of air and/or oxygen injected into the gasification reactor and the amount of air and/or oxygen and steam injected into the char bed reactor is controlled to maintain the endothermic/exothermic balance of the system. It is important to note that the gases formed by pyrolysis of the incoming particulate solid fuel in the gasification reactor are further heated by withdrawal through the char bed in the lower zone of the gasification reactor. The char withdrawn from the gasification reactor and delivered to the char bed reactor is also further heated in the char bed reactor before discharge.

The system may be operated at atmospheric pressure, above atmospheric pressure, or below atmospheric pressure. A pump 80 may be provided to pull the gases from the gasification reactor through the downcomer tubes, char bed and dip leg and may contain a catalyst to promote methanation. The gas stream exiting the gasification reactor at a temperature of about 1500° F. may be run through trays of lime for promotion of methanation.

Referring to the schematic, the distance "d," through which gases withdrawn from the upper zone of the gasification reactor must pass to enter the dip tube, is constant. This constant path is important in obtaining a uniform constituency of the gases exiting from the gasification reactor.

The system disclosed accomplishes almost complete gasification of solid particulate fuels without generation of volatiles or condensibles in large quantities. In many prior art systems, the incoming fuel to be pyrolized falls directly on a carbon bed, with no entrainment of the incoming gas stream. This results in a high amount of condensibles, which require more oxygen if they are to be converted to non-condensible gases. In constrast, the incoming particulate fuels in the system described are entrained in a very hot, substantially oxygen-free gas stream which rapidly pyrolyzes them. Further, any condensibles generated in the upper zone of the gasification reactor of the system described are broken down as those generated gases are fed through the bed of char in the lower zone of the gasification reactor.

The principal uses for a unit of this type are for generation of combustible gases containing a medium or high energy content for heating uses, such as heating of lime kilns or other high energy uses.

EXAMPLE

A char bed reactor 6 ft. in diameter and 12 ft. high containing a 6 in. insulative refractory lining (2 in. of high temperature fiber insulation and 4 in. of low iron content refractory) was filled with charcoal briquettes to a level above the point where the oxygen inlets 23 in the side walls of the vessel were located. An auxiliary propane heater having a heat output of about 200,000 BTU'S per hour was used to heat the bed of charcoal to 1200°–1300° F. At that temperature, a small amount of oxygen was injected into the bed to raise the temperature of the bed as high as possible, generally up to about 2000° F. At that temperature, a small amount of steam was injected into the bed to increase the temperature of the bed and the temperature of the gas stream generated. A small amount of oxygen was also injected into the reactor above the fixed bed. The resulting gas stream excited the char reactor at a temperature of approximately 3000° F. containing principally carbon dioxide. This hot gas stream, at a pressure of 1–2 psig, passed through the venturi which increases the velocity thereof. On the downstream side of the venturi, a sudden pressure drop aided in pulling in the particulate solid fuel being in-fed by a rotary airlock feeder containing eight pockets. The solid particulate fuel entrained in the very hot gas stream was rapidly pyrolyzed in the upper zone of the gasification reactor at approximately ambient pressure. The generated gases were drawn off through downcomer tubes in the gasification reactor and were withdrawn from the gasification reactor through the incandescent, fixed bed of carbon in the lower zone of the reactor through a dip leg in the reactor containing an iron wool catalyst. Oxygen was injected into the bed of incandescent carbon in the gasification reactor, as necessary, to maintain the temperature of the bed of carbon around 1600° F. The gas was pulled through the bed of incandescent carbon and from the reactor by a vacuum pump. The hot gases exited the gasification reactor at a temperature of about 1500° F. and were fed through a heat exchanger used to generate steam. The cooled gases exited the heat exchanger at a temperature of about 250° F. and a pressure of about minus 5 psig.

I claim:

1. A method for gasification of particulate carbonaceous fuel to generate a combustible gas containing a minimum amount of gases which are condensible at ambient temperature, comprising the steps of:

(a) fast pyrolyzing the fuel to generate a combustible gas stream and a char by entraining the fuel in a heated, substantially oxygen-free gas stream having a temperature of about 2000°–4000° F. by injecting the fuel into the moving stream;

(b) separating the combustible gas stream from the char;

(c) collecting the char into a char bed; and (d) passing the combustible gas stream through the char bed maintained at a temperature of between about 1600°–2500° F. to enhance the heat value of the combustible gas stream, to reduce the amount of gases which are condensible at ambient temperature, and to produce a residue from the char.

2. The method of claim 1 wherein the gas stream is passed a substantially fixed distance through the char bed.

3. The method of claim 2 wherein the substantially oxygen-free gas stream is produced by the steps of:

(a) burning the residue at a temperature of from about 1800°–2500° F. to form a combustion gas and ash; and (b) injecting an oxygen-containing gas into the combustion gas for further combustion to form the substantially oxygen-freen gas having a temperature of about 2000°–4000° F.

4. The method of claim 2 wherein the substantially oxygen-free gas stream has a temperature of at least about 3000° F.

5. The method of claim 2 wherein the char bed is maintained at a temperature of between about 1600°–2200° F. by passing an oxygen-containing gas through it.

6. The method of claim 2 wherein the step of injecting further includes the step of turbulently mixing the fuel with the substantially oxygen-free stream to improve heat transfer.

7. The method of claim 6 wherein the turbulent mixing is created by passing the gas stream through a venturi and adding the fuel just downstream of the venturi.

8. A gasification system to generate combustible gases which contain a minimum amount of gases that are condensible at ambient temperature, comprising:

(a) a reactor having (i) means for fast pyrolysis of the fuel to produce a combustible gas and a char, including (a) means for feeding the fuel to the reactor, and (b) means for the turbulent mixing of the fuel with a heated, substantially oxygen-free gas stream having a temperature between about 2000°–4000° F.; and (ii) means for separating the gas and char;

(iii) means for creating a char bed from the char;

(iv) means for passing the gas through a substantially fixed distance of the char bed to further pyrolyze the gas into a product having a reduced amount of gases that are condensible at ambient temperature and to produce a residue from the char;

(b) means for conveying the residue to a means for burning;

(c) means for burning the residue to produce the heated, substantially oxygen-free gas stream having a temperature of between about 2000°–4000° F.; and (d) means for conveying the heated, substantially oxygen-free gas to the reactor.

9. The reactor of claim 8, further comprising means for methanation of the product.

10. The reactor of claim 8 wherein the means for passing the gas through the char includes a fixed bed of char, means for injecting an oxygen-containing gas into the fixed bed, and means for cross-flow of the combustible gas of fast pyrolysis through the fixed bed.

* * * * *